United States Patent [19]

Carras

[11] 4,227,480

[45] Oct. 14, 1980

[54] MOTOR MOUNT BRACKET FOR TWIN-HULL SAIL BOATS

[75] Inventor: Peter A. Carras, Palm Beach Gardens, Fla.

[73] Assignee: Jane C. Terry, Hobe Sound, Fla.

[21] Appl. No.: 21,083

[22] Filed: Mar. 16, 1979

[51] Int. Cl.[2] ..... B63H 21/26

[52] U.S. Cl. ..... 440/63; 114/61; 114/163; 248/642

[58] Field of Search ..... 114/61, 39, 162, 163; 115/17, 18 B, 72, 18 R; 224/42.03 R, 42.07, 42.08, 42.45 R; 248/225.3, 226.3, 226.4, 291, 640, 641, 642, 643

[56] References Cited

U.S. PATENT DOCUMENTS

| | | | |
|---|---|---|---|
| 680,680 | 8/1901 | Armstrong et al. | 248/226.4 |
| 1,118,208 | 11/1914 | McLaren | 115/17 |
| 2,930,341 | 3/1960 | Gaston | 115/17 |
| 3,210,783 | 10/1965 | Petty | 114/61 X |
| 3,604,674 | 9/1971 | Wilkerson | 115/17 |
| 3,918,666 | 11/1975 | Florian | 248/641 |
| 4,089,448 | 5/1978 | Traeger | 224/42.03 R X |
| 4,102,287 | 7/1978 | Ferris | 114/61 X |

FOREIGN PATENT DOCUMENTS

| | | | |
|---|---|---|---|
| 1307305 | 9/1961 | France | 114/61 |

*Primary Examiner*—Trygve M. Blix
*Assistant Examiner*—Winston H. Douglas
*Attorney, Agent, or Firm*—Wolf, Greenfield & Sacks

[57] ABSTRACT

A motor mount bracket for use in combination with a twin-hull sail boat, to which an outboard motor can be affixed, and which can support the motor in a running location with its screw in the water between the hulls, or in a stowed location with its screw out of the water. The bracket has a stand-off for attachment to the aft-most cross-strut of the sail boat, and an arm pivotally connected at its forward end to the stand-off at a pivot-point that is below and somewhat aft of the cross-strut. A motor mount is at the aft-end of the arm. The arm pivots through a vertical sweep between the running location and the stowed location.

10 Claims, 7 Drawing Figures

MOTOR MOUNT BRACKET FOR TWIN-HULL SAIL BOATS

BACKGROUND OF THE INVENTION

Twin-hull sail boats are a form of catamaran that has gained great popularity. Typical components are two hulls, or pontoons, spaced apart by a forward cross-strut and an aft cross-strut, with a deck supported between the hulls. In light-weight models that are commercially available, the deck is sometimes made of fabric stretched between the forward and aft cross-struts, and between frames running parallel to the struts; such a deck is sometimes called a trampoline. A mast, sails and guy lines provide the propulsion system, and two rudder pivoted one at the aft end of each hull provide the steering system. Typically, rudder arms extend forward one from each rudder, and the forward ends of these arms are joined by a tiller cross-link through which the rudders are steered in unison. Boats of this general description are commercially available under such trademarks or names as "Hobe Cat", "Prindle", "Toronado" and "Sole Cat", for example.

Typically, such twin-hull boats respond quickly, and accelerate rapidly in response to the slightest wind but, being light in weight, have little stored momentum and so they just as quickly lose forward motion when the wind dies. In regions where the wind is not constant, or where the wind velocity varies down to nothing from one place to another, they are frequently and easily be-calmed. Yet owing to their light weight and meagre mechanical structures, they afford little or no place to carry a motor for only occasional use, with the result that sailing sometimes gives way to paddling.

GENERAL NATURE OF THE INVENTION

The present invention provides a motor mount bracket for use in combination with a twin-hull sail boat of the type described, to which an outboard motor can be affixed, and which can support the motor in a running location with its screw in the water between the hulls, or in a stowed location with its screw out of the water. In either location, neither the motor nor the mount mechanism will interfere with the operation of the steering mechanism or the operation of the sails. The bracket is attached to the aft-most cross-strut through a stand-off which attaches rigidly to the strut and provides a pivot below and aft of that strut for an arm extending aft from the strut and holding a mount for the motor at its aft-most end. In some cases, the stand-off provides a rest for the tiller cross-link. In all cases, it holds the arm, and a motor when fixed to the mount, pivotal in a vertical sweep that is clear of the tiller cross-link throughout its normal operating range, and clear of the aftward-extending mainsail boom when the mast is properly trimmed. The mount, and available small horsepower motors, are together of sufficiently small weight that they can be carried with boats of the type described without adversely affecting balance or trim. The mount is designed to present a minimum of alteration to the forward or side profiles of the boat.

THE PRIOR ART

U.S. Pat. No. 3,210,783 of T. V. Petty shows a twin-hull boat with a retractable wheel mechanism for towing the boat on land, and an outboard motor for propelling the boat afloat.

The motor is mounted to a transom 94 on the stern end of a scoop 96 which is pivoted at its bow end to brackets 97 secured to the framework, as is described at column 3, lines 1–16, of the patent. The depth of the screw in the water is set by holes 100 in a pair of angle brackets 98. The boat shown and described is not a sail boat. The motor is not retractable out of the water.

U.S. Pat. No. 4,040,134 shows a motor-driven catamaran in which passing mention is made of a motor 50 secured to a rear end of the main frame (column 2, lines 11–13). Again, the boat shown is not a sail boat.

An early mount for outboard motors fitted to a twin-hull boat is shown in U.S. Pat. No. 1,190,663. In this mount, the motor shaft depends directly from a horizontal pivot, for letting the motor swing aft-ward to ride over obstructions, as is shown in FIG. 3 of the patent. The pivot axis of the pins 20 is above the pontoons.

U.S. Pat. No. 3,348,794 to Hayes shows a double-ended single-hull sail boat with a stern well in which an outboard motor may be stored when not in use. The motor mount is supported by a complex arrangement of links which is spring-loaded to hold a motor in either of two locations—a running location with the propeller-shaft extending through a hole in the bottom of the well, and a stowed location entirely within the well.

Other U.S. patents relating to outboard motor mounts which have been found in the prior art are U.S. Pat. Nos. 2,643,837; 2,264,364; 2,713,843; 2,757,888; 2,782,744; 2,928,631; 2,997,014; 3,511,460; 3,604,674; and 3,666,218.

BRIEF DESCRIPTION OF THE DRAWINGS

For a better understanding of the invention, reference is made, by way of example, to the accompanying drawings, in which.

DETAILED DESCRIPTION OF THE DRAWINGS

Figure 1:
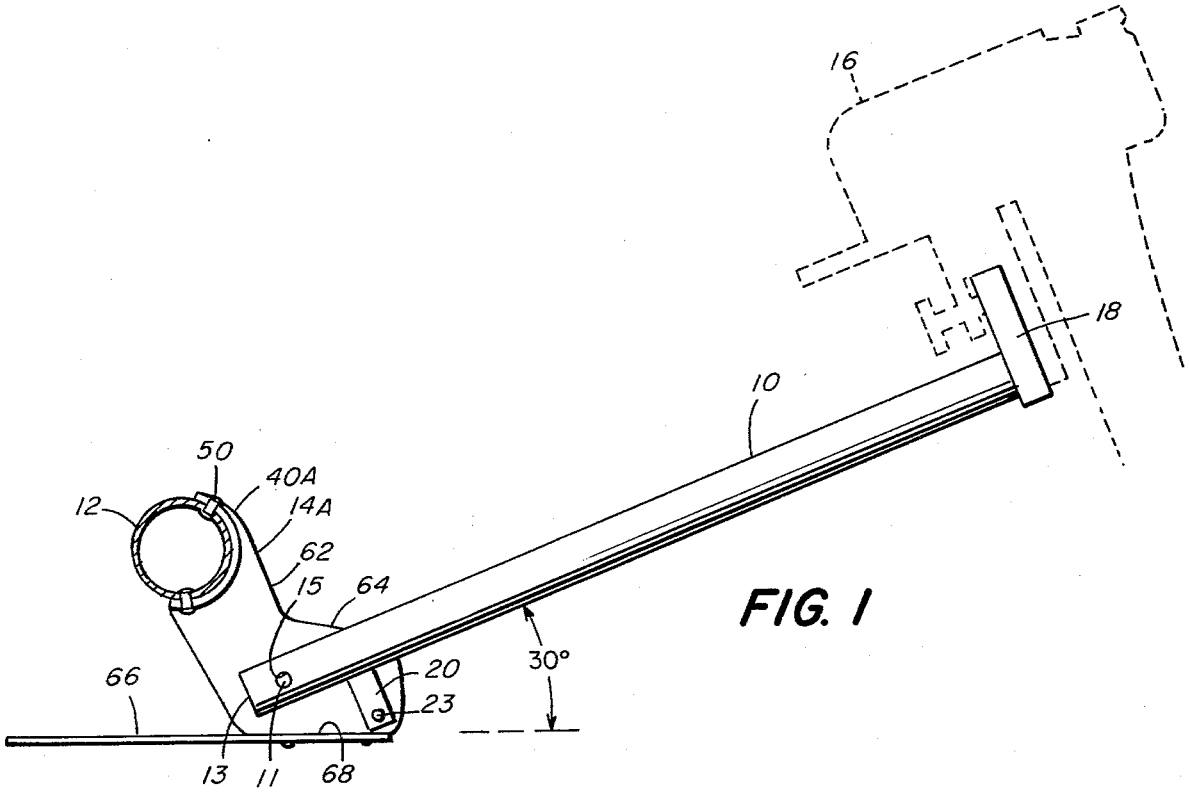
FIG. 1 is a side view partly in section of a bracket according to the invention installed on a cross-strut.
Figure 2:
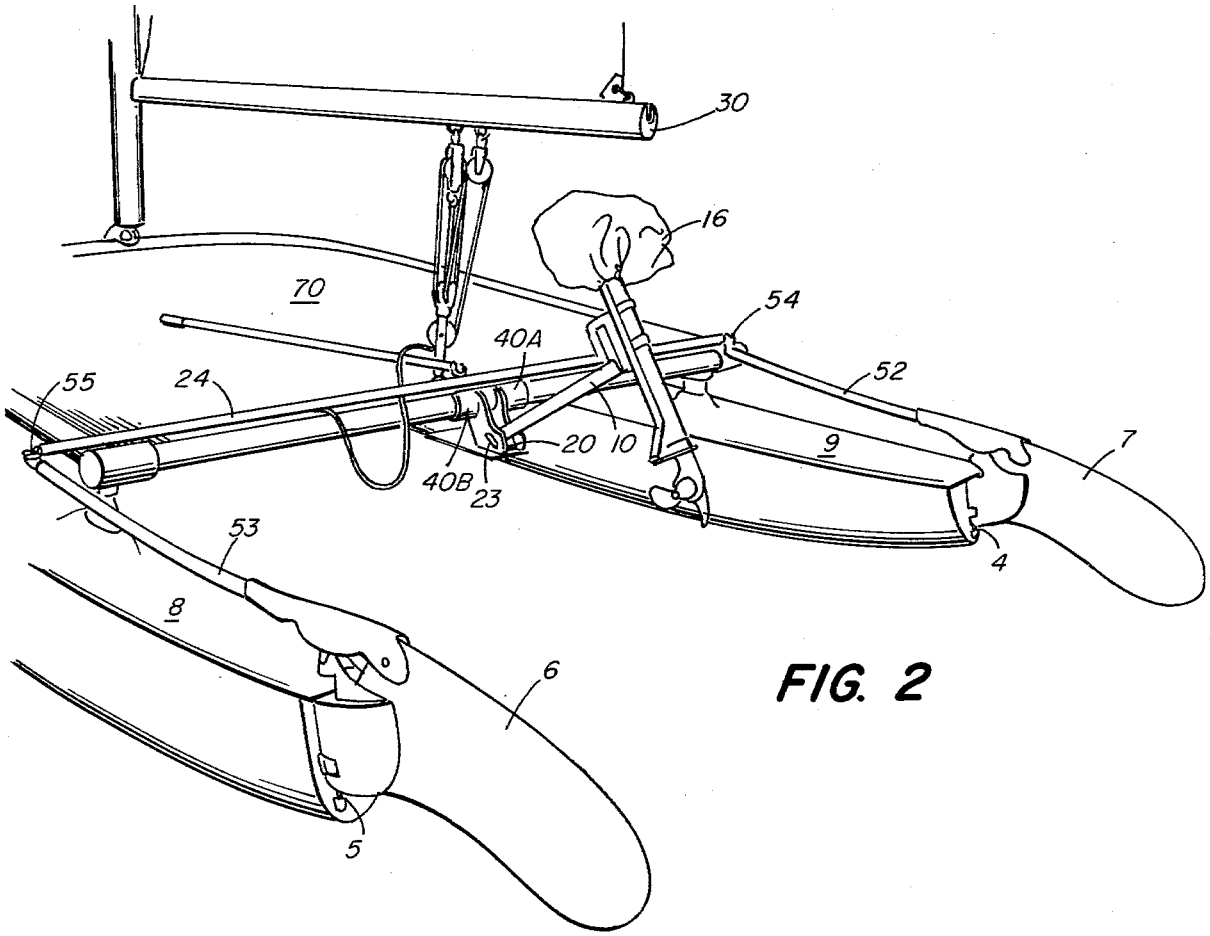
FIG. 2 is a view from the aft port quarter of a boat having a bracket of the invention installed.
Figure 5A:
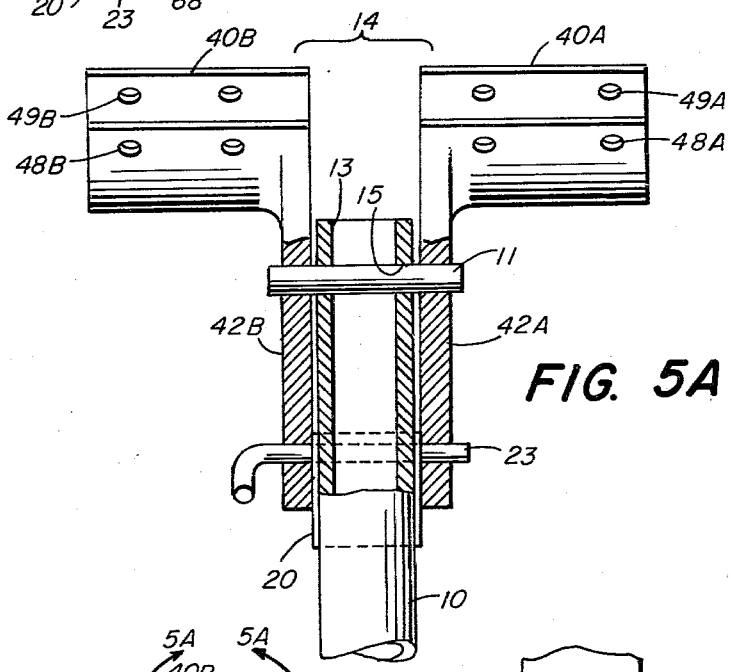
FIG. 5A is an enlarged view of a part of FIG. 5.
Figure 5:
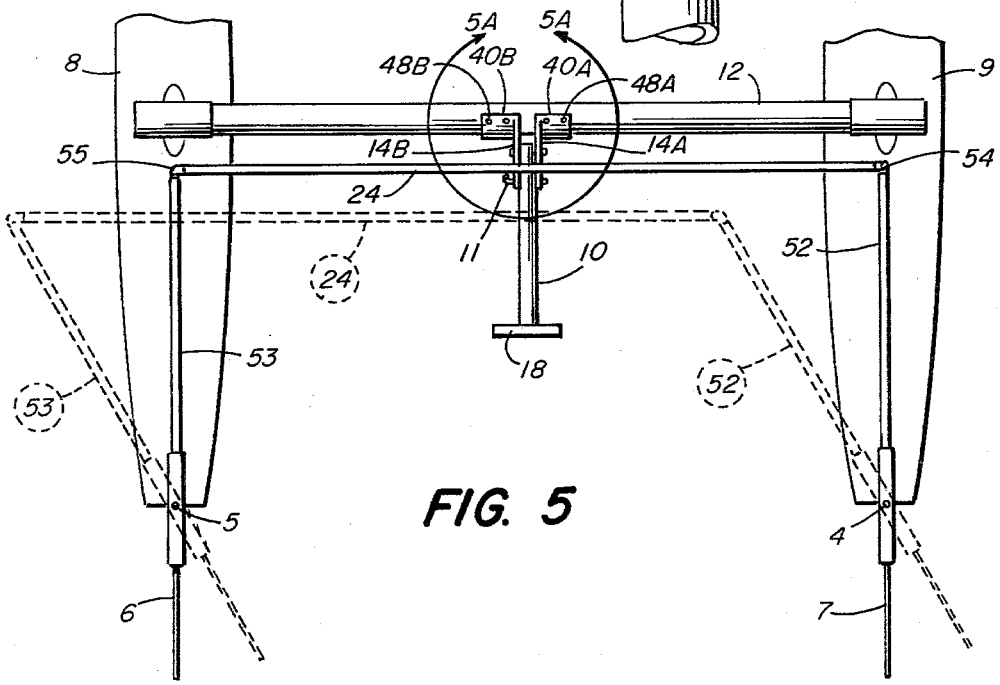
FIG. 5 is a schematic view illustrating the relation between an installed bracket according to the invention and the neighboring tiller parts of a twin-hull boat on which the bracket is installed.
Figure 6:
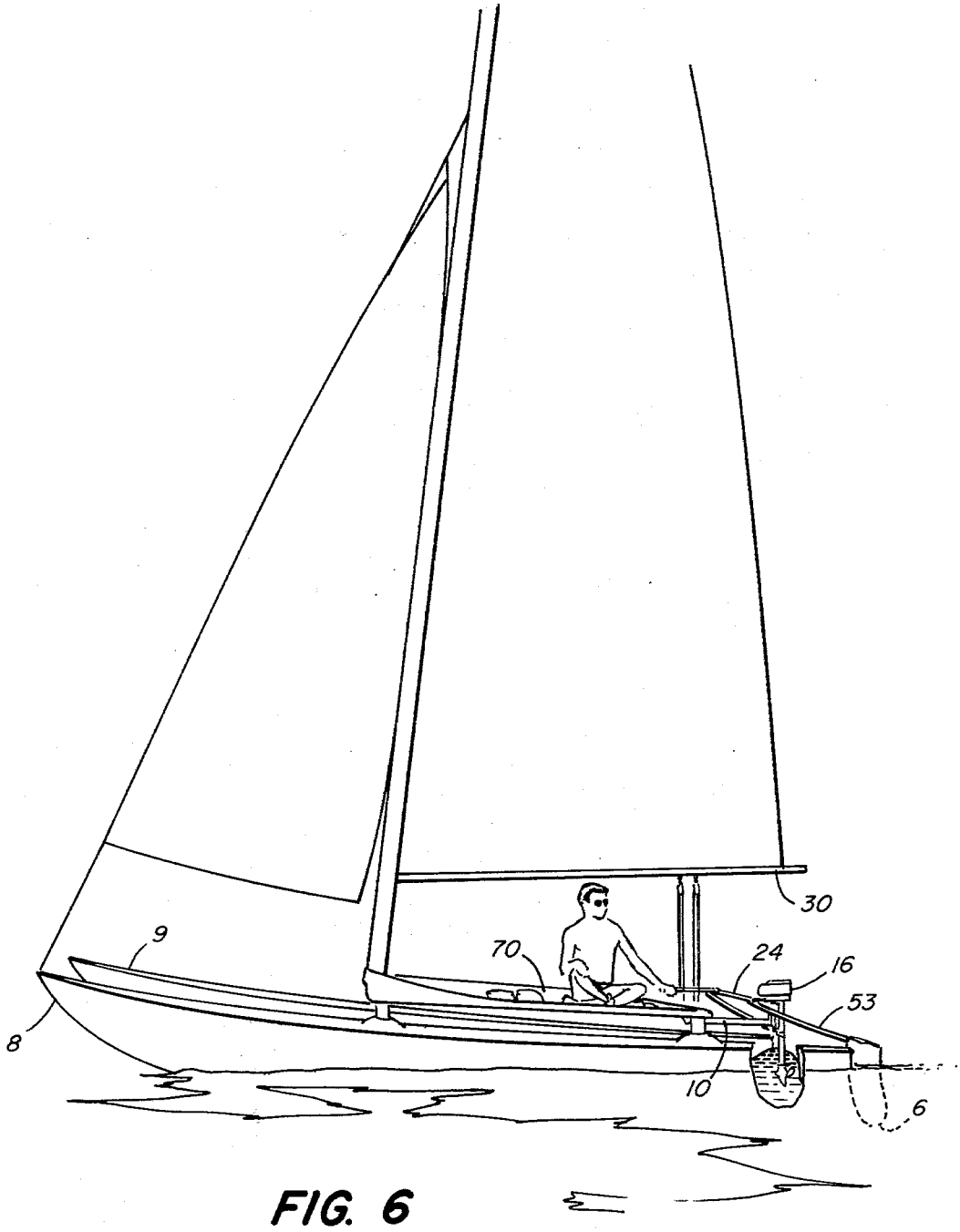
FIG. 6 is a general side view of a twin-hull boat under way using a motor carried by an installed bracket according to the invention.

The bracket illustrated in the drawings comprises in general a stand-off 14 supporting a dependant pivot 11 for the forward end of an aft-extending arm 10 which bears at its aft end a fixed mount 18 for an outboard motor 16. By means of a cam block 20 which turns on a pivot 23 the arm 10 can be placed in a horizontal position (FIG. 3) or in an elevated position (FIG. 1). The bracket is illustrated installed on a twin-hull boat having two hulls 8, 9 and two rudders 6, 7 linked by a tiller cross-link 24, the operating features of which are described in connection with FIG. 5. The boat has a main mast boom 30 extending generally horizontally aft when the boat is in the water and properly trimmed (FIGS. 2 and 6). The arm 10 can swing through a vertical sweep around its pivot 11, between the horizontal position in which the motor 16 is in a running location with its screw in the water, between the hulls and a vertical position in which the motor 16 is in a stowed location with its screw out of the water. As will be explained, when the motor is in the stowed location, neither the motor 16 nor the arm 10 will interfere with the tiller link 24 or the boom 30. As is apparent in the discussion of the background of the invention, the invention is directed primarily to providing a motor mount bracket for occasional use of a motor aboard a light weight twin-hull sail boat, when the boat is becalmed or cannot use its sails for other reasons, such as, for going in and out of canals, going in and out of inlets against winds and tides, and for docking. Generally speaking, a user will not attempt to motor-sail unless winds are very light, and the motor is not intended for general use together with the sails. Thus for the most part the motor will be in its stowed location when the boat is sailing, and it is of major importance that neither the motor nor its mount can interfere with the operation of the sails or the rudders during sailing.

The stand-off 14 is preferably made in two parts, 14A and 14B (FIGS. 4 and 5A), which are mirror-images one of the other. Each part comprises, in one piece, a generally arc-shaped attaching flange 40A, 40B which is shaped to embrace the aft-most strut 12 for a limited part of the circumference of the strut (see FIG. 1). The flanges 40A and 40B extend a fixed distance lengthwise of the strut 12, in opposite directions when affixed to the strut, as is best shown in FIGS. 2 and 5. A mount-pivot member 42A, 42B, respectively, extends radially from each flange at the inner edge of the flange when installed on the strut 12 so that the two mount pivot members 42A, 42B will provide a space (about $1\frac{3}{4}$ inches, for example) between them to receive the forward end 13 of the arm 10. A bolt 11 passing through registering holes 43A, 43B in the respective mount pivot members and a corresponding hole 15 in the forward end 13 of the arm 10 provides the mount pivot for the arm 10. A further hole 46A, 46B, respectively, located further aft and downward from the holes 43A, 43B, in each mount pivot member provides pivotal support for the pivot 23 of the cam block 20. The cam block is fixed to its pivot with a set screw 22. Each flange is bored to provide a row of holes 48A, 48B, respectively at its top edge, and another row of holes 49A, 49B, respectively, at its bottom edge. Fastening members 50, one of which is indicated in FIG. 1, pass through each of the holes in the top row and through respective registering holes drilled into the cross-strut 12. Stainless steel pop-rivets are available for this use. The holes in the top row are located so that the fasteners 50 will be oriented nearer to vertical than to horizontal, so as to increase the probability that shear forces will predominate over tensile forces imposed on the fasteners 50 when downward forces are applied to the stand-off 14 through the arm 10.

Some twin-hull sail boats that are now on the market are designed so that the rudders can be turned on a horizontal pivot to extend the rudders horizontally when the boat is beached, as is shown in FIG. 2. With the rudders 6, 7, so extended horizontally, the tiller cross-link 24 can be moved downward relative to the aft-most cross-strut 12. The contour of each mount pivot member 42A, 42B provides a relatively vertical rear edge 62 (FIG. 4) extending downward from the flange 40A, 40B sufficiently forward to allow the tiller cross-link to pass by it downwardly. At the lower portion which contains the pivots 11 and 23 the contour of the upper edge 64 of each mount pivot member changes to horizontal, providing a rest for the tiller cross-link. In FIG. 1, a relatively vertical rear edge 62 and the following relatively horizontal upper edge 64 of a representative mount pivot member 14A are indicated.

Referring to FIG. 5, the tiller cross-link 24 is pivotally connected at spaced-apart points 54, 55 (its ends in FIG. 5) to the forward ends of the rudder control arms 52, 53, respectively. The two hulls or pontoons 8, 9 are fitted with rudders 6, 7, respectively, which are pivotally connected at the aft-end of each pontoon. When the rudders are set dead-ahead the tiller link 24 is in a first position which is the nearest it will be to the aft-most cross-strut 12. When the rudders are set for a turn, the tiller link 24 will be in a second position further aft from the aft-most cross-strut 12. The pivoted connecting points 54, 55 and rudder pivots 4, 5 define the four corners of a parallelogram in which the rudder pivots 4, 5 are fixed relative to the cross-strut 12, while the tiller link pivot points 54, 55 are movable, thereby carrying the tiller link between two extreme positions, one further aft than the other. The motor mount arm 10 is dimensioned so that in either of its locations, the running location or the elevated stowed location, neither the motor 16 (shown in dashed line in FIG. 1) nor the arm 10 will interfere with the motion of the tiller cross-link 24, or with the main mast boom 30 (FIG. 2). In the elevated (stowed) location, the arm 10 makes an angle approximately 30 degrees relative to the horizontal (water surface). The cam 20 is dimensioned to provide an acceptable elevation angle, in the position shown in FIG. 1.

Figure 3:
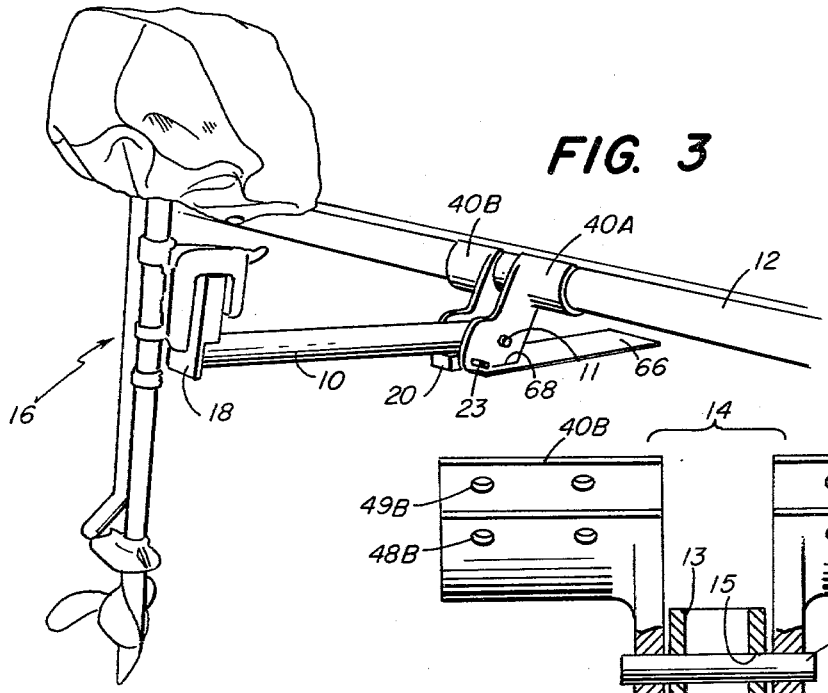
FIG. 3 is a partial view of an installed bracket from the starboard aft quarter.
Figure 4:
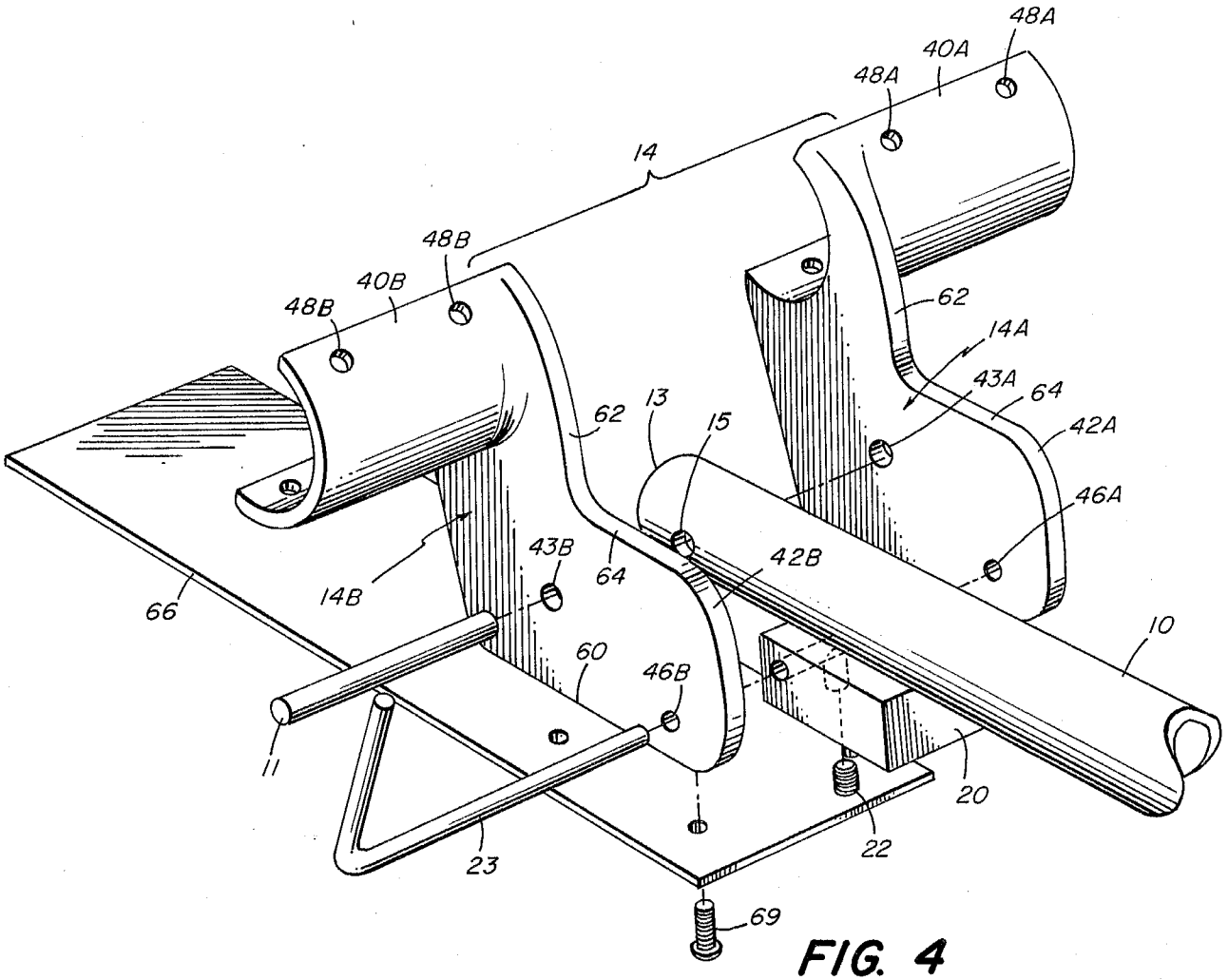
FIG. 4 is an exploded view of the stand-off portion of the bracket with parts attached to it.

A splash plate 66 is fitted to the under edges 68 of the mount pivot members 42A, 42B, as is shown in FIGS. 1, 3 and 4. The splash plate is fastened to the under edges 68 with machine screws 69, and extends forward a fixed distance under the deck of the boat (not shown). This plate is useful to deflect away from passengers on a trampoline 70, for example, spray arising from water splashing on the underside of the stand-off and arm parts 10 and 14.

Preferably, the stand-off members 14A and 14B are made of cast aluminum, and the arm 10 is made of aluminum pipe to the aft-end of which a plate is welded to hold a wooden block 18 as the fixed mount for the outboard motor 16. The arm 10 can be made of a 20 inch pipe having an outer diameter of $1\frac{1}{4}$ inches. The pivot pin 11 can be $\frac{3}{8}$ inch in diameter, and the cam pivot pin 23 can be $\frac{1}{4}$ inch in diameter. The overall distance from the center line of the aft-most strut 12 to the motor mount 18 can be about 22 inches. This distance is convenient for a sailor on the deck 70, as shown in FIG. 6, allowing easy reach to the motor controls without requiring long control cables, although remote controls for the motor can be installed if desired. The motor 16 will be a small horsepower motor of light weight, so that a user sitting on the deck can easily grasp the arm 10 and lift the motor out of the water into the stowed location, and turn the cam block 20 to hold the motor in the stowed location.

I claim:

1. A motor mount bracket for use in combination with a twin-hull sail boat of the kind having first and second pontoons spaced parallel to each other by at least a first forward cross-strut and a second aft-most cross-strut to which the pontoons are rigidly attached, each pontoon extending a distance aft from the second strut and having first and second rudders pivotally connected to the aft-end of each pontoon, respectively, first and second rudder control arms extending from said first and second rudders, respectively, forward toward said second strut, and an elongated tiller link extending parallel to said second strut pivotally connected at first and second separated points to the forward ends of said first and second control arms, respectively, for moving said rudders in unison around their respective pivots, said forward connecting points and said rudder pivots defining the four corners of a parallelogram in which said tiller link is movable between a first position closely adjacent said second strut when said rudders are set dead ahead, and a second position further aft from said second strut when said rudders are set for a turn; said motor mount bracket comprising a stand-off intended to be fixed to said second cross-strut between the pontoons, said stand-off when so affixed extending below and aft of said second cross-strut and providing a mount pivot located below and aft of said second cross-strut and below said tiller link, rigid motor support means including an arm pivotally attached at a forward point to said stand-off at said mount pivot, said arm extending aft from said mount pivot and having fixed to it a mount for an outboard motor, said mount being located a prescribed distance aft from said mount pivot which prescribed distance is substantially less than the distance aft from said second cross-strut to said rudder pivots but sufficiently far aft from said second cross-strut to hold an outboard motor clear of said tiller link in said second position.

2. A motor mount bracket according to claim 1 including locating means on said stand-off to locate said arm in a first direction extending substantially horizontally relative to the water surface when said boat is afloat for holding an outboard motor in a running location when said motor is present on said mount, said locating means being operable to locate said arm in a second direction extending upward and aft from said mount pivot at an upward angle to the horizontal for holding said motor in a stowed location with its screw out of the water when said boat is afloat, said angle being dimensioned together with said prescribed distance to hold said motor clear of said tiller link in said second position when said motor is in said stowed location.

3. A motor mount bracket according to claim 2 wherein said locating means comprises a cam pivotally mounted to said stand-off at a region below and aft of said mount pivot for engaging the underside of said arm in a region aft of said mount pivot, and means to turn said cam between a first limit in which said cam allows said arm to take said first direction and a second limit in which said cam holds said arm elevated into said second direction.

4. A motor mount bracket according to claim 2 wherein said upward angle is approximately 30 degrees.

5. A motor mount bracket according to claim 1 wherein said stand-off comprises in one piece a generally arc-shaped attaching flange which is shaped to embrace said second strut for a limited part of the circumference of the strut, and to extend a fixed distance lengthwise of said strut, and a mount pivot member extending radially from said flange to provide said mount pivot, said flange being fitted with holes along top and bottom edges extending lengthwise of said strut through which holes fastening members such as rivets, bolts or the like may be passed to attach the flange to the strut, said flange extending upward to the top surface of said strut so that the holes at the top edge will be located in a position which permits fastening members passing through them to be oriented nearer to vertical than to horizontal when said boat is afloat, so as to increase the probability that shear forces will predominate over tensile forces imposed on said fastening members when downward forces are applied to said stand-off through said arm.

6. A motor mount according to claim 1 wherein said stand-off comprises in one piece a generally arc-shaped attaching flange which is shaped to embrace said second strut for a limited part of the circumference of the strut, and a mount pivot member extending radially from said flange to provide said mount pivot, said mount pivot member extending downward and aftward from said second strut when said attaching flange is fixed to the strut, said mount pivot member having an aft-facing surface which is curved to provide a rest for said tiller link.

7. A motor mount bracket for use in combination with a twin-hull sail boat of the kind having first and second pontoons spaced parallel to each other by at least a first forward cross-strut and a second aft-most cross-strut to which the pontoons are rigidly attached, said motor mount bracket comprising a stand-off intended to be fixed to said second cross-strut between the pontoons, said stand-off when so affixed extending below and aft of said second cross-strut and providing a mount pivot located below and aft of said second cross-strut, rigid motor support means including an arm pivotally attached at a forward point to said stand-off at said mount pivot, said arm extending aft from said mount pivot and having fixed to it a mount for an outboard motor, locating means on said stand-off to locate said arm in a first direction extending substantially horizontally relative to the water surface when said boat is afloat for holding an outboard motor in a running location when said motor is present on said mount, said locating means being operable to locate said arm in a second direction extending upward and aft from said mount pivot at an upward angle to the horizontal for holding said motor in a stowed location with its screw out of the water when said boat is afloat.

8. A motor mount bracket according to claim 7, wherein said locating means comprises a cam pivotally mounted to said stand-off at a region below and aft of said mount pivot for engaging the underside of said arm in a region aft of said mount pivot, and means to turn said cam between a first limit in which said cam allows said arm to take said first direction and a second limit in which said cam holds said arm elevated into said second direction.

9. A motor mount bracket according to claim 7, wherein said stand-off comprises in one piece a generally arc-shaped attaching flange which is shaped to embrace said second strut for a limited part of the circumference of the strut, and to extend a fixed distance lengthwise of said strut, and a mount pivot member extending radially from said flange to provide said mount pivot, said flange being fitted with holes along top and bottom edges extending lengthwise of said strut through which holes fastening members such as rivets, bolts or the like may be passed to attach the flange to the strut, said flange extending upward to the top surface of said strut so that the holes at the top edge will be located in a position which permits fastening members passing through them to be oriented nearer to vertical than to horizontal when said boat is afloat, so as to increase the probability that shear forces will predominate over tensile forces imposed on said fastening members when downward forces are applied to said standoff through said arm.

10. A motor mount bracket according to claim 7 wherein said upward angle is approximately 30 degrees.

* * * * *